US005186700A

United States Patent [19]

Wang

[11] Patent Number: 5,186,700

[45] Date of Patent: Feb. 16, 1993

[54] PEDALING EXERCISE DEVICE

[75] Inventor: John Wang, Chiayi, Taiwan

[73] Assignee: Lee Wang Industry Ltd., Taiwan

[21] Appl. No.: 936,586

[22] Filed: Aug. 27, 1992

[51] Int. Cl.[5] ..... A63B 21/008

[52] U.S. Cl. ..... 482/111; 482/80

[58] Field of Search ..... 482/79, 80, 111, 112, 482/148, 113, 57-59

[56] References Cited

U.S. PATENT DOCUMENTS 3,741,540 6/1973 Shimizu ..... 482/80
3,821,951 7/1974 Giles ..... 482/80
4,204,675 5/1980 McGinnis ..... 482/112

FOREIGN PATENT DOCUMENTS 2261989 6/1974 Fed. Rep. of Germany ..... 482/111

*Primary Examiner*—Stephen R. Crow

*Attorney, Agent, or Firm*—Harness, Dickey & Pierce

[57] ABSTRACT

A pedaling exercise device includes two pairs of pedaling plates, each of which has an upper plate and a lower plate hinged to the upper plate. Two pressure-operating members are respectively provided between the upper and lower plates of the pairs of pedaling plates. Each of the pressure-operating members includes an enclosed flexible hollow housing having an upper partition and a lower partition dividing the housing into a first, a second and a third chamber from top to bottom. A first flexible tube interconnects and communicates the first and third chambers. A predetermined amount of air is contained in the second chambers. A predetermined amount of liquid is contained in the first and third chambers and in the first flexible tube. A second flexible tube communicates the second chambers of the housing. A pumping device is provided for pumping air into and for allowing air to escape from the second chambers.

3 Claims, 2 Drawing Sheets

PEDALING EXERCISE DEVICE

BACKGROUND OF THE INVENTION

1. Field of the Invention

This invention relates to an exercise device, more particularly to a pedaling exercise device.

2. Description of the Related Art

Conventionally, pedaling exercise devices include two pedaling plates. The user's feet pedal up and down on the pedaling plates for exercising purposes. The pedaling plates are usually connected to hydraulic or gas cylinders, so that the pedaling plates can automatically move upward after downward pressure thereto is released. However, the hydraulic or gas cylinders are complicated in construction and have high manufacturing costs.

SUMMARY OF THE INVENTION

It is therefore a main object of this invention to provide a pedaling exercise device which is simple in construction and which has a low manufacturing cost.

Accordingly, a pedaling exercise device of this invention includes two pairs of pedaling plates each of which includes an upper plate and a lower plate hinged to the upper plate. Two pressure-operating members are respectively provided between the upper and lower plates of the pairs of pedaling plates. Each of the pressure-operating members includes an enclosed flexible hollow housing having an upper partition and a lower partition dividing the housing into a first, a second and a third chamber from top to bottom. The upper and lower partitions have a first flexible tube connected therebetween to communicate the first and third chambers. Each of the second chambers has a predetermined amount of air contained therein. The first and third chambers and the first flexible tube have a predetermined amount of liquid contained therein. The housings have a second flexible tube connected therebetween to communicate the second chambers. A pumping means is provided for pumping air into and for allowing air to escape from the second chambers.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
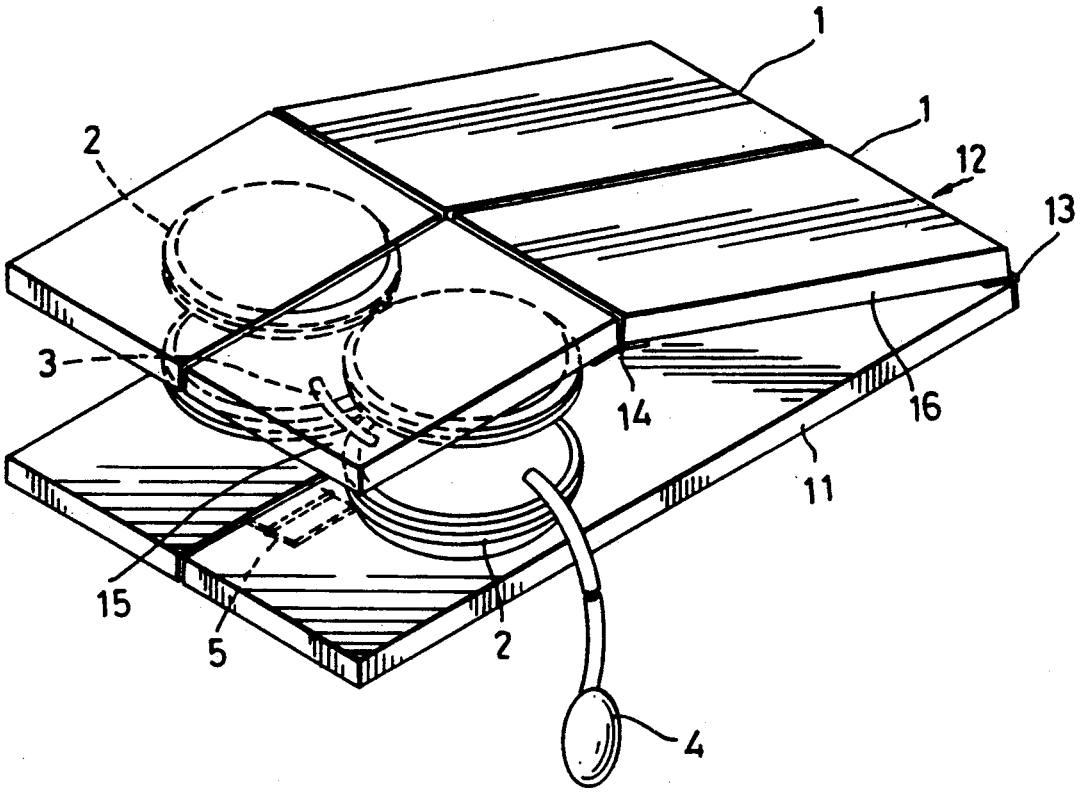
FIG. 1 is a perspective view of a preferred embodiment of a pedaling exercise device of this invention.

FIG. 1 shows a perspective view of a preferred embodiment of a pedaling exercise device of this invention. The pedaling exercise device includes two pairs of pedaling plates 1 juxtaposed to each other. Each pair of the pedaling plates 1 includes an upper plate 12 and a lower plate 11 hinged to the upper plate 12 by means of a hinge member 13. The upper and lower plates 12 and 11 can rotate about the hinge member 13 so as to move toward each other. The upper plate 12 is formed with a first section 16 and a second section 15 connected to the first section 16 by means of a hinge member 14.

Figure 2:
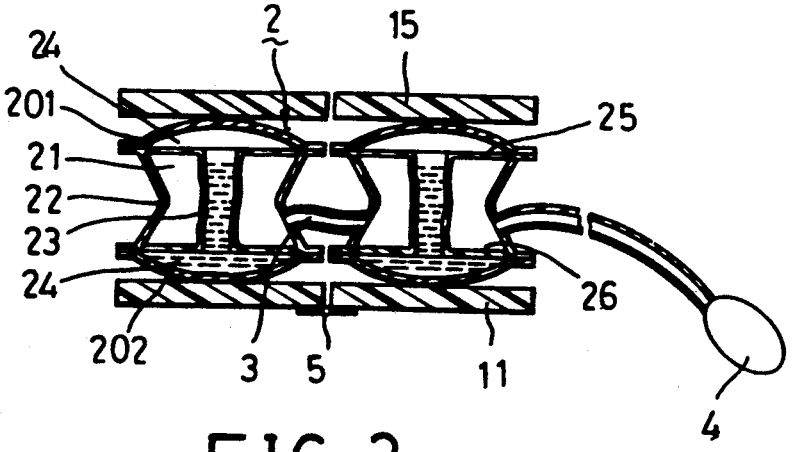
FIG. 2 is a sectional front view of the preferred embodiment of the pedaling exercise device of this invention.
Figure 3:
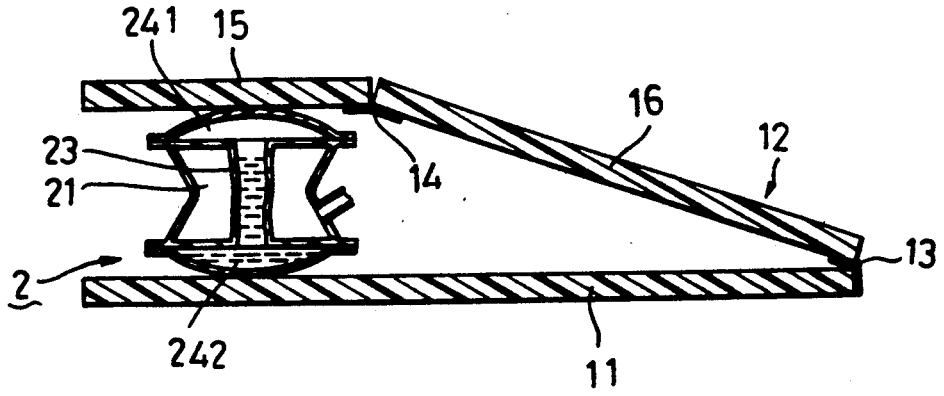
FIG. 3 is a sectional side view of the preferred embodiment of the pedaling exercise device of this invention.
Figure 4:
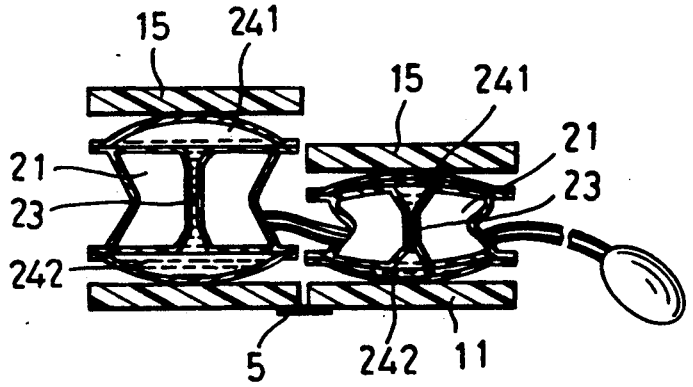
FIG. 4 is a sectional side schematic view of the preferred embodiment of the pedaling exercise device of this invention when in an operative position.

Referring to FIGS. 2 and 3, two pressure-operating members 2 are respectively provided between the second section 15 of the upper plate 12 and the lower plate 11 of the pairs of pedaling plates 1. Each of the pressure-operating members 2 includes an enclosed flexible hollow housing having a top wall 201 abutting the second section 15 of the upper plate 12 and a bottom wall 202 abutting the lower plate 11. Each housing has a restricted portion 22 formed on an intermediate section thereof. An upper partition 25 and a lower partition 26 divides the housing into a first, a second and a third chamber (241, 21, 242) from the top wall 201 to a bottom wall 202 of the housing. The upper and lower partitions (25, 26) have a first flexible tube 23 connected therebetween to communicate the first and third chambers (241, 242). Each of the second chambers 21 has a predetermined amount of air contained therein. The amount of air in the second chambers 21 can be adjusted as desired by operating an air pumping bulb 4 or a gas release device (not shown) connected to one of the housings so as to pump air into one of the second chambers 21 or allow air to escape from the second chambers 21. The first and third chambers (241, 242) and the first flexible tube 23 have a predetermined amount of liquid contained therein. The liquid may be water or a cooling agent which can be used to absorb the frictional heat created during the operation of the pedaling exercise device. The pressure-operating members 2 have a second flexible tube 3 connected therebetween in order to communicate the second chambers 21. Therefore, the air in one of the second chambers 21 can flow to the other one of the second chambers 21 when the pedaling plates 1 are alternatively pedaled by the user, as best illustrated in FIG. 4.

When one of the pedaling plates 1 are pedaled, the pressure-operating member 2 disposed between said one of the pedaling plates 1 are compressed, thereby causing part of the air in the second chamber 21 of said pressure-operating member 2 to flow into the other one of the second chambers 21. The first and third chambers (241, 242) and first flexible tube 23 in the compressed pressure-operating member 2 are compressed until the liquid fills the same. A rigid support is thus formed in the pressure-operating member 2, thereby preventing further downward movement of the upper plate 12. The user may pedal the other one of the pedaling plates 1 to force air back into the compressed pressure-operating member 2 so as to urge the previously pedaled upper plate 12 to move upward. Therefore, the user can alternatively pedal the pedaling plates 1 for exercising purposes.

Figure 5:
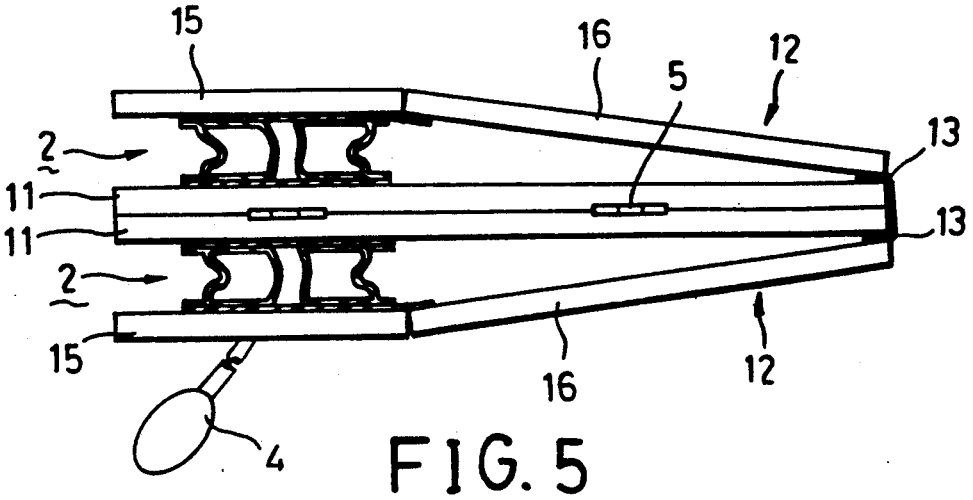
FIG. 5 is a side view of the preferred embodiment of the pedaling exercise device of this invention when in a folded position.

The lower plates 11 of the pedaling exercise device are hinged to each other by a hinge member 5. Therefore, the two pedaling plates 1 can be folded toward each other in order to reduce the storage and transport space of the pedaling exercise device of the invention, as best illustrated in FIG. 5.

With this invention thus explained, it is apparent that numerous modifications and variations can be made without departing from the scope and spirit of this invention. It is therefore intended that this invention be limited only as indicated in the appended claims.

I claim:

1. A pedaling exercise device, comprising:

two pairs of pedaling plates each of which includes an upper plate and a lower plate hinged to said upper plate;

two pressure-operating members respectively provided between said upper and lower plates of said pairs of pedaling plates, each of said pressure-operating members including an enclosed flexible hollow housing having a top wall adjacent to said upper plate and a bottom wall adjacent to said lower plate, an upper partition and a lower partition dividing said housing into a first, a second and a third chamber from said top wall to said bottom wall of said housing, said upper and lower partitions having a first flexible tube connected therebetween to communicate said first and third chambers, each of said second chambers having a predetermined amount of air contained therein, said first and third chambers and said first flexible tube having a predetermined amount of liquid contained therein, said housings having a second flexible tube connected therebetween to communicate said second chambers; and means for pumping air into and for allowing air to escape from said second chambers.

2. A pedaling exercise device as claimed in claim 1, wherein said lower plates of said pedaling plates are hinged to each other.

3. A pedaling exercise device as claimed in claim 1, wherein each of said upper plates of said pedaling plates includes a first section and a second section hinged to said first section, each of said pressure-operating members being disposed between a respective said second section of said upper plate and a respective said lower plate.

* * * * *